US007189113B2

(12) United States Patent
Sattele et al.

(10) Patent No.: US 7,189,113 B2
(45) Date of Patent: Mar. 13, 2007

(54) COAXIAL PLUG CONNECTOR AND MATING CONNECTOR

(75) Inventors: Fred Sattele, Löffingen-Unadingen (DE); Roland Baumgärtner, Bonndorf-Wellendingen (DE)

(73) Assignee: IMS Connector Systems GmbH, Löffingen (DE)

( * ) Notice: Subject to any disclaimer, the term of this patent is extended or adjusted under 35 U.S.C. 154(b) by 0 days.

(21) Appl. No.: 11/037,822

(22) Filed: Jan. 18, 2005

(65) Prior Publication Data

US 2006/0099853 A1 May 11, 2006

(30) Foreign Application Priority Data

Nov. 5, 2004 (DE) ..... 10 2004 054 022.5

(51) Int. Cl.
*H01R 9/05* (2006.01)

(52) U.S. Cl. ..... 439/578; 439/253

(58) Field of Classification Search ..... 439/578, 439/253–257, 350–354, 357, 358; 285/319
See application file for complete search history.

(56) References Cited

U.S. PATENT DOCUMENTS 3,569,903 A * 3/1971 Brishka ..... 439/352
6,267,612 B1 * 7/2001 Arcykiewicz et al. ..... 439/253
6,692,286 B1 2/2004 De Cet ..... 13/627
6,769,926 B1 8/2004 Montena ..... 4/38
6,848,931 B2 * 2/2005 McMullen et al. ..... 439/350
2003/0027435 A1 2/2003 Schneider et al.

FOREIGN PATENT DOCUMENTS

DE 2 353 004 3/1974 ..... 13/54
DE 44 39 852 4/1998 ..... 17/12
EP 1 222 717 B1 7/2002

* cited by examiner

*Primary Examiner*—Ross Gushi
(74) *Attorney, Agent, or Firm*—Nath & Associates PLLC; Jerald L. Meyer; Matthew J. Moffa

(57) ABSTRACT

A connector includes a plug connector and a mating connector. The plug connector includes a housing with an open front end, an insulated inner conductor disposed within the housing, a clamping sleeve, and an axially movable sliding sleeve disposed radially outside the clamping sleeve. The sliding sleeve can be positioned in a working position where it surrounds the clamping sleeve and exerts a radially inward-directed force. The mating connector, which is receivable within the housing, includes a clamping surface. A force $F_r$ introduced radially from the sliding sleeve toward the clamping sleeve when the sliding sleeve is in the working position, is redirected by the clamping sleeve into an axial force component $F_a$ which is introduced from the clamping sleeve toward the clamping surface.

21 Claims, 3 Drawing Sheets

COAXIAL PLUG CONNECTOR AND MATING CONNECTOR

BACKGROUND OF THE INVENTION

The invention relates to coaxial plug connectors and an associated mating connectors.

A plug connector/mating-connector combination is disclosed in EP 1 222 717 B1. In this prior-art plug connector, a clamping sleeve pretensioned in the radial direction is used to introduce a radial force into the mating connector. This introduced radial force is redirected into an axial force component by a circumferential clamping surface inclined relative to the longitudinal axis of the mating connector. The prior-art plug connector/mating-connector combination thus always requires a clamping surface inclined relative to the longitudinal axis of the mating connector in order to redirect the initially radially introduced force into an axial force component.

SUMMARY OF THE INVENTION

An object of the present invention is to create a plug connector in which an outer-conductor contact surface of the mating connector can be tensioned against an outer-conductor contact surface of the plug connector, independently of the design of the clamping surface, that is, even with a clamping surface running perpendicular to the longitudinal axis of the mating connector.

According to an aspect of the present invention, a coaxial plug connector and mating connector is provided. The plug connector has a housing with an open front end. The plug connector is traversed by a channel in which an insulated inner conductor contact is located. The plug connector includes a clamping sleeve and an axially movable sliding sleeve to mechanically connect the housing to the mating connector. In a working position, the sliding sleeve surrounds the clamping sleeve and exerts a radially inward-directed force. The clamping sleeve can be moved into contact with a clamping surface on the mating connector. An outer-conductor contact surface of the mating connector is axially tensionable against an outer-conductor contact surface of the plug connector. A force $F_r$ introduced radially in the working position from the sliding sleeve onto the clamping sleeve is redirected by the clamping sleeve into an axial force component $F_a$ which is introduced directly from the clamping sleeve into the clamping surface.

An aspect of the invention is to introduce the axial force component directly from the clamping sleeve into the clamping surface of the mating connector rather than first introducing a radial force which must then be redirected at the clamping surface into an axial force component.

Since the axial force component is introduced directly (e.g., by the clamping sleeve itself based on its shape into the clamping surface), there is no need for force redirection at the clamping surface. As a result, the clamping surface may, if required, run perpendicular to the longitudinal axis of the mating connector.

The present invention obviates the need to incline the clamping surface relative to the longitudinal axis.

The design of the invention advantageously allows even a radial force component to be introduced from the clamping sleeve, for example from the clamping sleeve into a compensation surface of the mating connector. As a result, all of the radial force components acting on the mating connector are compensated such that even in the case of a clamping surface with an inclined design only one axial force component is introduced into this component.

In one embodiment, introduction of the axial force component from the clamping sleeve into the clamping surface is effected by moving the clamping sleeve into the working position. This means that an axial force component is not automatically transmitted from the clamping sleeve onto the clamping surface after the plug connector and mating connector are joined. To achieve an axial force component, the sliding sleeve must be moved to the working position. In the working position a radial force is exerted on the clamping sleeve. As a result, the free end of the clamping sleeve is pressed axially in the direction of the clamping surface, with the result that an axial force component is introduced directly from the clamping sleeve into the mating connector. In an embodiment of the invention, the clamping sleeve is initially spaced a certain distance from the clamping surface after the plug connector and mating connector are joined. When the sliding sleeve is moved into the working position, the clamping sleeve is moved towards the clamping surface and tensioned axially against the clamping surface.

In one embodiment of the invention, the introduction of the radial force component into the compensation surface is created by moving the sliding sleeve into the working position. The clamping sleeve is initially spaced a certain distance from the compensation surface, and is then moved against the compensation surface by moving the sliding sleeve into the working position.

In an alternative embodiment, the clamping sleeve is radially pretensioned such that a radial force component is immediately introduced directly into the compensation surface of the counterpart when the sliding sleeve is still located in a ready position and has not yet been moved into the working position.

According to an one embodiment, the clamping surface runs perpendicular to the longitudinal axis of the mating connector. The clamping surface is disposed on an outside radially projecting rib of the mating connector and/or on a radially inward-pointing recess of the mating connector. The clamping surface and/or compensation surface may run circumferentially around the mating connector.

According to another embodiment of the invention, the clamping sleeve extends from the plug connector, or from the end opening of the plug connector, axially past the clamping surface of the mating connector, and the end region is bent or bent back towards the clamping surface. The end region of the clamping sleeve runs at an acute angle to the longitudinal axis of the mating connector. In order to improve the tensioning effect in the axial direction, the clamping sleeve has a region flaring radially outward which is preferably located directly adjacent to the bent-back end region.

In order to provide the radial movement of the clamping sleeve, the clamping sleeve is provided with axially oriented slots, thereby forming snap-in tongues. The snap-in tongues are interconnected at one end by a circumferential ring section. Alternatively, the clamping sleeve includes spaced tension springs extending axially and distributed around the periphery of the plug connector.

Advantageously, the sliding sleeve surrounds the clamping sleeve even in a ready position in which the clamping sleeve does not introduce axial force into the clamping surface. The sliding sleeve can be moved axially between a ready position and a working position. The sliding sleeve is designed so that even in the ready position a radial force, albeit a small one, is exerted on the clamping sleeve. However, the radial force introduced by the sliding sleeve into the clamping sleeve is sufficiently large only in the working position to enable the clamping sleeve to introduce an axial force component into the clamping surface of the mating connector.

In alternative embodiments, the sliding sleeve substantially exerts no force on the clamping sleeve when the sliding sleeve is in the ready position.

It is advantageous to have the clamping sleeve at its outer radial, specifically, end region be received within a recess on the inner circumference of the sliding periphery. The recess advantageously has a radially tapering axial section, thereby enabling the sliding sleeve to move axially more easily from the ready position into the working position.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
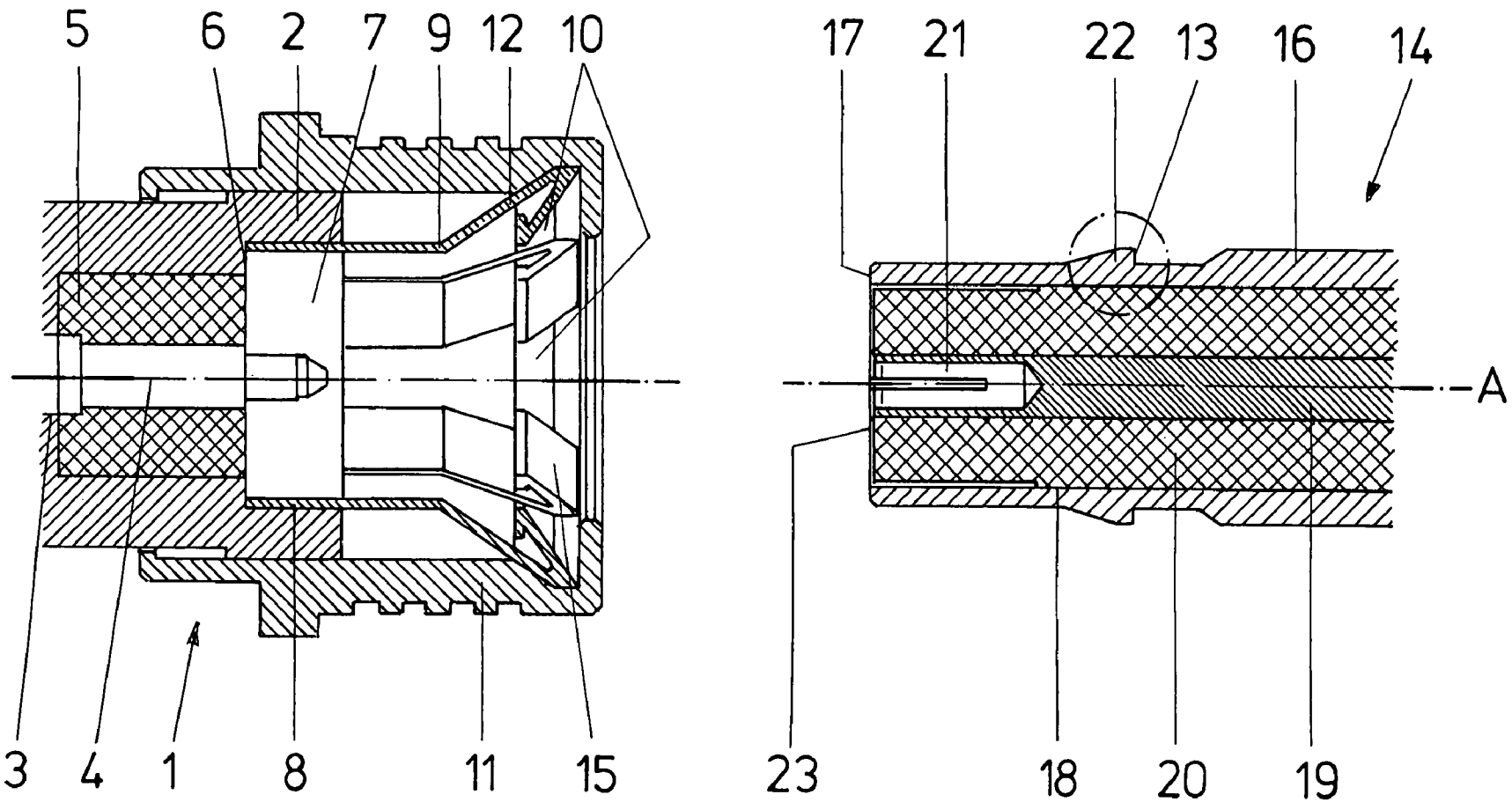
FIG. 1 is a section through a plug connector according to the invention, as well as a section through a mating connector separated from the plug connector.

FIG. 1 illustrates a section through a coaxial plug connector 1. The coaxial plug connector 1 has a housing 2 which is open at the front end and is traversed by a channel 3. An inner conductor contact 4 is located in the channel 3 and insulated from the housing 2 by an insulator 5. The housing 2 forms an outer conductor and has in the end opening an annular circumferential outer-conductor contact surface 6. The end of insulating sleeve 5 is flush with the outer contact surface 6.

Within the front-end opening of the plug connector 1, an axially projecting clamping sleeve 8 is attached, pressed radially into the opening 7. The clamping sleeve 8 is provided with axial slots 10, thereby creating multiple spring-elastic snap-in tongues 9.

Figure 2:
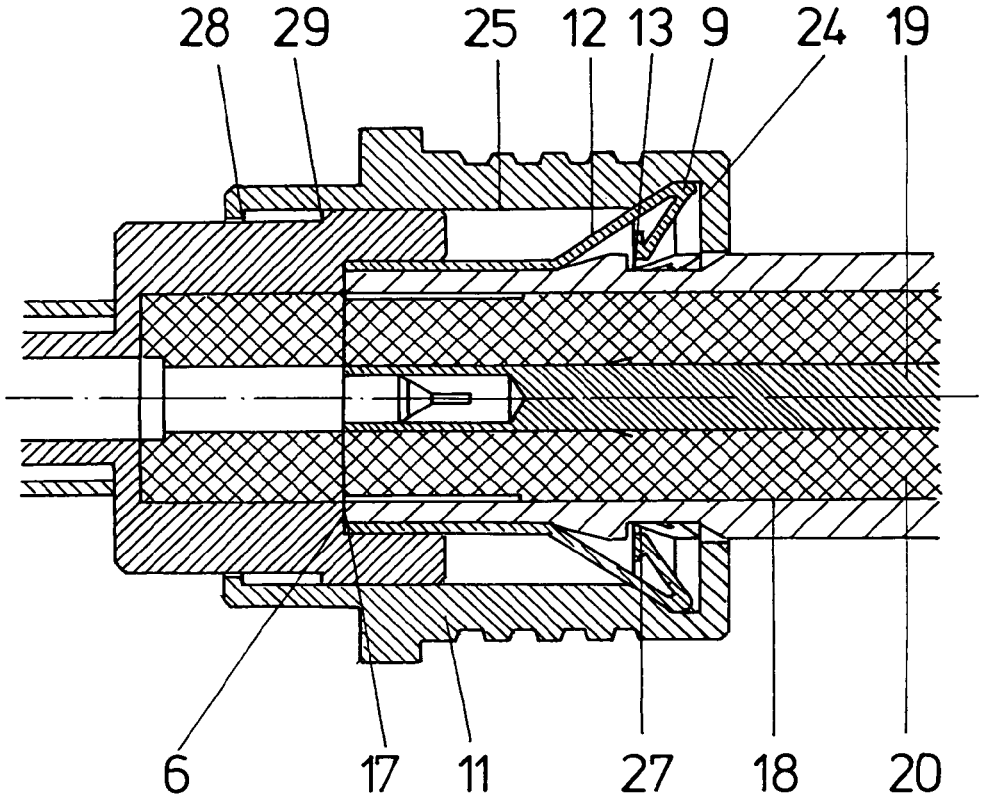
FIG. 2 is a section through the plug connector with attached mating connector and including a sliding sleeve in the ready position.

A sliding sleeve 11, which is axially movable within a limited extent, surrounds the clamping sleeve 8. In FIGS. 1 and 2, the sliding sleeve 11 is located in a ready position in which it does not exert any force on the snap-in tongues 9.

Figure 3:
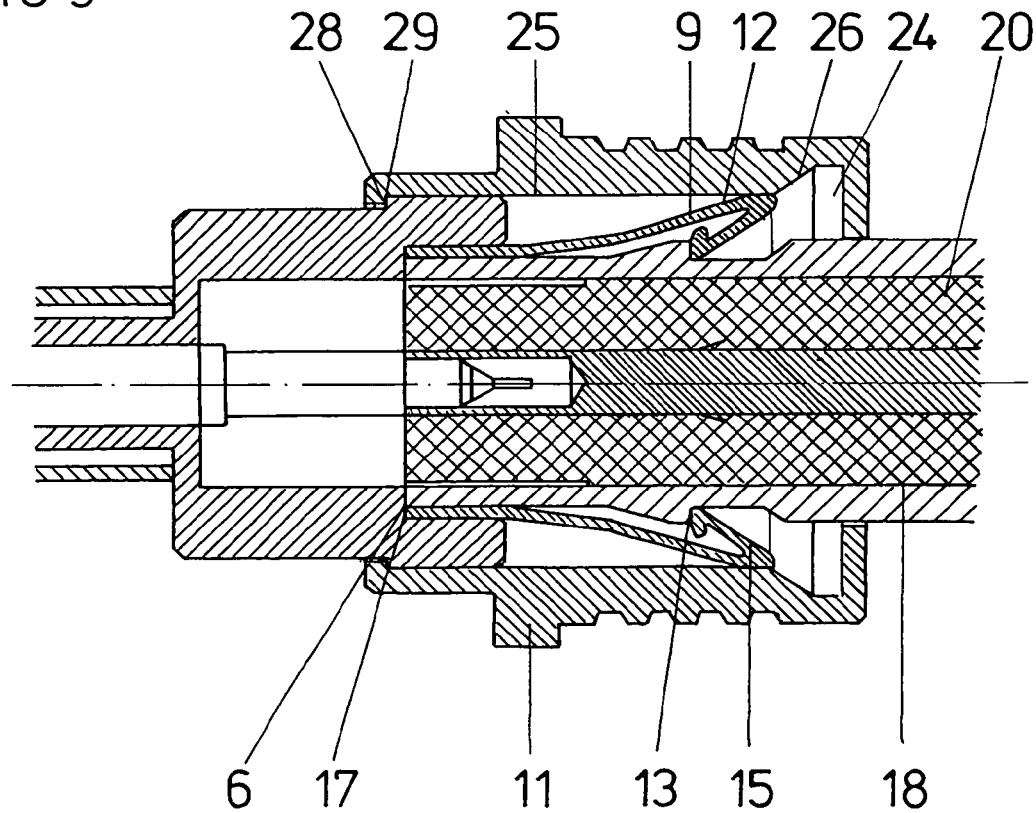
FIG. 3 is a section through the plug connector with attached mating connector and including a sliding sleeve in the working position.

The snap-in tongues 9 run axially and parallel to the longitudinal axis A of the plug connector 1, starting from a circumferentially closed region. Adjoining this area is a region 12 that expands radially outward at an angle. As is seen in FIG. 2, the snap-in tongues 9 together with a widening region 12 are diverted axially along a clamping surface 13 of a mating connector 14. A region 15 of the snap-in tongues 9, which is bent back towards the front-end opening 7, directly adjoins the region 12 of the snap-in tongues 9 which widens radially outward. With the bent-back region 15, the snap-in tongues 9 are returned axially towards the clamping surface 13 and radially towards the longitudinal axis A of mating connector 14. As is shown in FIG. 3, the last end piece of the snap-in tongues 9 is bent back and runs radially outward to form an enlarged support surface on the clamping surface 13.

The mating connector 14 has an outer conductor in the form of an essentially cylindrical housing 16. At its front end, the housing 16 has an annular circumferential outer-conductor contact surface 17. An insulator 20 is located in a continuous channel 18 of the housing 16. A conductor 19 is located within the insulator 20. At the front end of the conductor 19, a socket 21 is provided to receive the inner conductor contact 4 of the plug connector 1. The inner conductor contact 4 projects axially towards the mating connector 14.

In the embodiment shown in FIG. 1, the clamping surface 13 is located on a rib 22 of the mating connector 14, the rib 22 projecting radially outside, while the clamping surface 13 runs orthogonally relative to the longitudinal axis A of the mating connector 14.

In FIG. 2, the mating connector 14 is attached to the plug connector 1. To accomplish this, the mating connector 14 is inserted axially by its front end into the clamping sleeve 8 until the two contact surfaces 6 and 17 make contact. During the attachment process in the embodiment shown, the clamping sleeve 8 is briefly stretched elastically in a radial direction. This does not necessarily have to occur, however. The relative gap between the snap-in tongues 9 can be dimensioned in such a way that the mating connector 14 can move into the position shown in FIG. 2 without the snap-in tongues 9 having to be expanded radially. As was mentioned, the sliding sleeve 11 in FIG. 2 is located in the ready position in which it surrounds all the snap-in tongues 9. The snap-in tongues 9 are received at their radially outer end regions within a circumferential recess 24 on the inner periphery 25 of the sliding sleeve 11. The recess 24 is dimensioned such that the sliding sleeve 11 does not exert any radial force on the clamping sleeve 8. The recess 24 has an axial section 26 which narrows radially. In the ready position shown in FIG. 2, the snap-in tongues 9 do not contact either the clamping surface 13 or a compensation surface 27 of the mating connector 14, which surface 27 runs parallel to the longitudinal axis A of the mating connector 14. Consequently, no force is exerted by the snap-in tongues 9 on the mating connector 14.

FIG. 3 shows the sliding sleeve 11 in a working position. To arrive at the working position, the sliding sleeve 11 is moved axially from the retracted ready position shown in FIG. 2 towards the mating connector 14. The axial movement is limited by a circumferential, inward-pointing edge 28 provided on the end of the sliding sleeve 11, the edge 28 coming to rest on a radially outward-facing opposing surface 29 of the plug connector housing 2.

During the axial movement of the sliding sleeve 11, the axial section 26 is displaced along the radially expanding axial section 12 of the snap-in tongues 9 until the radially outer-most region of the snap-in tongues 9 comes to rest on the inner periphery 25 (i.e., the sliding steeve 11 is moved parallel to the longitudinal axis A of the sliding sleeve). As a result, a radial force $F_R$ is applied by the snap-in tongues 9. The radial force $F_R$ generates an axial force component $F_a$ within the tongues 9 that is introduced directly into the clamping surface 13 of the mating connector 14. As FIG. 3 shows, the snap-in tongues 9 deform in the working position of the sliding sleeve 11 in such a way that the original kinked shape of the snap-in tongues 9 is substantially straightened.

Figure 4:
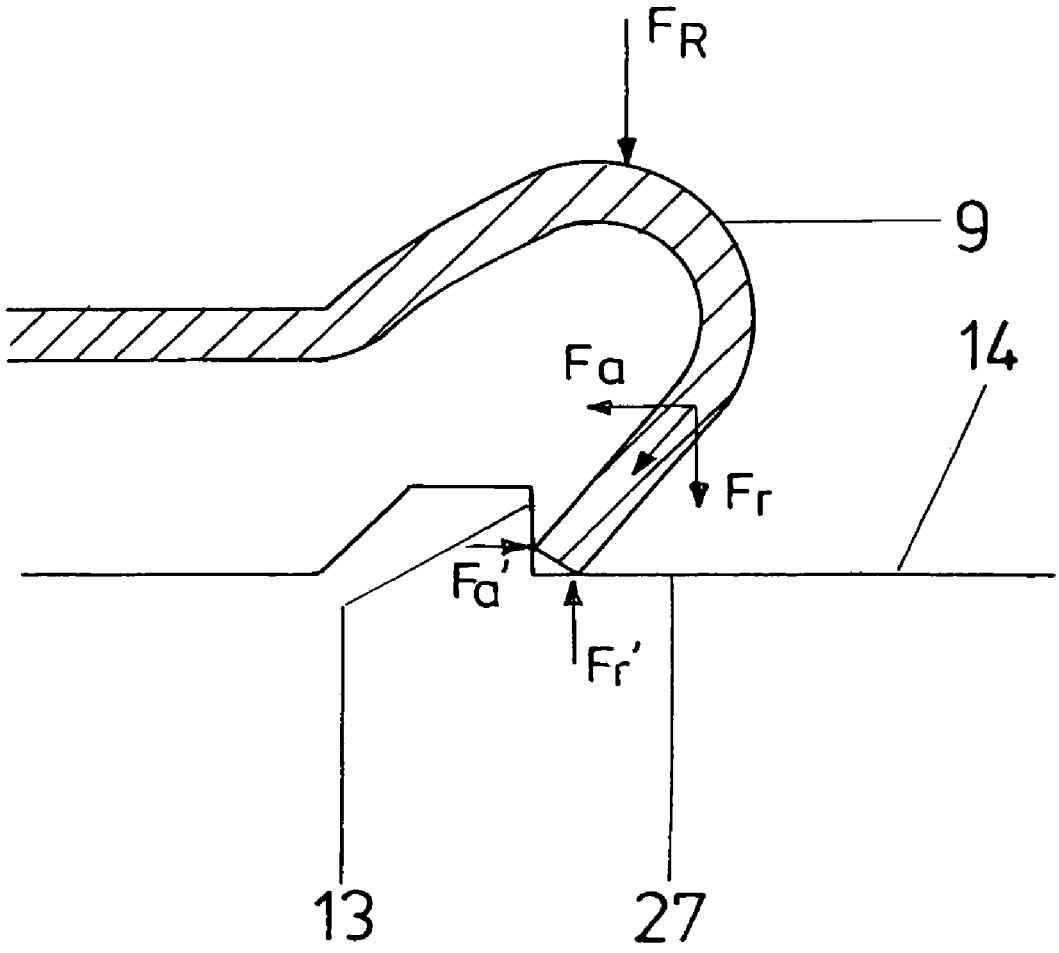
FIG. 4 is a schematic enlargement showing details from FIG. 3.

FIG. 4 schematically illustrates the force pattern of the snap-in tongues 9 when in the working position as shown in FIG. 3. As explained above, a radial force $F_R$ is introduced into the snap-in tongues 9 in the working position by the sliding sleeve 11. As a result, an axial force component $F_a$ and a radial force component $F_r$ are created in the snap-in tongues 9. The axial force component $F_a$ is introduced directly from the free ends of the snap-in tongues 9 into the clamping surface 13 running perpendicular to the longitudinal axis A of the mating connector 14, where it generates a counterforce $F_{a''}$. The radial force component $F_r$ is introduced directly from the free ends of the snap-in tongues 9 into the compensation surface 27 which surrounds the mating connector 14 and runs parallel to the longitudinal axis A of the mating connector 14 where it generates a counterforce or compensation force $F_{r''}$. In an alternative to the arrangement shown schematically in FIG. 4, the free ends of the snap-in tongues 9 may rest flat against the clamping surface 13 and/or compensation surface 27.

Due to the fact that all the radial force components $F_r$ are compensated on compensation surface 27, only the axial force component $F_a$ is introduced into the clamping surface 13, despite the fact that the clamping surface 13 is of an angled design with respect to longitudinal axis A of the mating connector 14.

Although the present invention has been illustrated and described with respect to several preferred embodiments thereof, various changes, omissions and additions to the form and detail thereof, may be made therein, with departing from the spirit and scope of the invention.

What is claimed is:

1. Coaxial plug connector and mating connector, wherein the plug connector comprises a housing with an open front end that allows attachment of the mating connector and which is traversed by a channel in which an insulated inner conductor contact is located, including a clamping sleeve and an axially movable sliding sleeve to mechanically connect the housing to the mating connector, wherein the sliding sleeve can be positioned in a working position where it surrounds the clamping sleeve and exerts a radially inward-directed force, wherein the mating connector has a first contact surface oriented parallel to the longitudinal axis of the mating connector and a second contact surface oriented perpendicular to the longitudinal axis of the mating connector, and wherein the clamping sleeve can be moved into contact with a clamping surface on the mating connector, and wherein an outer-conductor contact surface of the mating connector is axially tensionable against an outer-conductor contact surface of the plug connector, wherein a force $F_R$, introduced radially from the sliding sleeve toward the clamping sleeve when the sliding sleeve is in the working position, is split into an axial force component $F_a$ and a radial force component $F_r$ by a snap-in tongue, wherein the radial force component $F_r$ is fed into the first contact surface and compensated by the first contact surface and only the axial force component $F_a$ is fed into the second contact surface.

2. Coaxial plug connector and mating connector according to claim 1, wherein the radial force component $F_r$ is introduced from the clamping sleeve directly toward the first contact surface of the mating connector.

3. Coaxial plug connector and mating connector according to claim 1, wherein one or both of the axial force component $F_a$ from the clamping sleeve toward the second contact surface, and the radial force component $F_r$ toward the first contact surface is created by moving the sliding sleeve into the working position.

4. Coaxial plug connector and mating connector according to claim 1, wherein the clamping sleeve is movable into contact with the second contact surface by moving the sliding sleeve into the working position.

5. Coaxial plug connector and mating connector according to claim 1, wherein the second contact surface is provided on one or both of an outside radially projecting rib of the mating connector and a radially inward-pointing recess of the mating connector.

6. Coaxial plug connector and mating connector according to claim 1, wherein one or both of the first contact surface and the second contact surface surrounds the mating connector.

7. Coaxial plug connector and mating connector according to claim 1, wherein the clamping sleeve is provided with axially oriented slots.

8. Coaxial plug connector and mating connector according to claim 1, wherein the sliding sleeve surrounds the clamping sleeve in a ready position in which the clamping sleeve does not introduce substantially any axial force component $F_a$ into the second contact surface.

9. Coaxial plug connector and mating connector according to claim 1, wherein the clamping sleeve includes an end region and the end region is received within a recess disposed within the sliding sleeve.

10. Coaxial plug connector and mating connector according to claim 1, wherein the clamping sleeve is diverted axially past the second contact surface, and an end region is bent back or bent in the direction of the first contact surface.

11. Coaxial plug connector and mating connector according to claim 10, wherein the clamping sleeve has a radially outward expanding region adjacent the end region.

12. A connector, comprising:

a plug connector having a housing with an open front end, an insulated inner conductor disposed within the housing, a clamping sleeve, and an axially movable sliding sleeve disposed radially outside the clamping sleeve;

wherein the sliding sleeve can be positioned in a working position where it surrounds the clamping sleeve and exerts a radially inward-directed force $F_R$;

and a mating connector receivable within the housing, the mating connector having a first contact surface oriented parallel to the longitudinal axis of the mating connector and a second contact surface oriented perpendicular to the longitudinal axis;

wherein the force $F_R$ is split into an axial force component $F_a$ and a radial force component $F_r$ by a snap-in tongue, wherein the radial force component $F_r$ is fed into the first contact surface and compensated by the first contact surface and only the axial force component $F_a$ is fed into the second contact surface.

13. A connector, comprising:

a plug connector having a housing with an open front end, an insulated inner conductor disposed within the housing, a clamping sleeve, and an axially movable sliding sleeve disposed radially outside the clamping sleeve;

wherein the sliding sleeve is positionable in a first position where it exerts a radially inward-directed force $F_R$ toward the clamping sleeve, and in a second position where it exerts substantially no radially inward-directed force toward the clamping sleeve;

and a mating connector receivable within the housing, the mating connector having a first contact surface oriented parallel to the longitudinal axis of the mating connector and a second contact surface oriented perpendicular to the longitudinal axis;

wherein the force $F_R$ is split into an axial force component $F_a$ and a radial force component $F_r$ by a snap-in tongue, wherein the radial force component $F_r$ is fed into the first contact surface and compensated by the first contact surface and only the axial force component $F_a$ is fed into the second contact surface.

14. The connector of claim 13, wherein one or both of the first contact surface and the second contact surface surrounds the mating connector.

15. The connector of claim 13, wherein one or both of the axial force component and the radial force component is created by moving the sliding sleeve into the first position.

16. The connector of claim 13, wherein the clamping sleeve is movable into contact with one or both of the first contact surface and the second contact surface by moving the sliding sleeve into the first position.

17. The connector of claim 13, wherein the second contact surface is provided on one or both of an outside radially projecting rib of the mating connector and a radially inward-pointing recess of the mating connector.

18. The connector of claim 13, wherein the clamping sleeve is provided with axially oriented slots.

19. The connector of claim 13, wherein the clamping sleeve includes an end region and the end region is received within a recess disposed within the sliding sleeve.

20. The connector of claim 13, wherein the clamping sleeve is diverted axially past the second contact surface, and an end region is bent back or bent in the direction of the second contact surface.

21. The connector of claim 20, wherein the clamping sleeve has a radially outward expanding region adjacent the end region.

* * * * *